US007874287B1

(12) United States Patent
Freden

(10) Patent No.: US 7,874,287 B1
(45) Date of Patent: Jan. 25, 2011

(54) AIR INTAKE APPARATUS

(76) Inventor: Wayne H. Freden, P.O. Box 505, Kasilof, AK (US) 99610

( * ) Notice: Subject to any disclaimer, the term of this patent is extended or adjusted under 35 U.S.C. 154(b) by 253 days.

(21) Appl. No.: 12/266,020

(22) Filed: Nov. 6, 2008

(51) Int. Cl.
*F24C 1/14* (2006.01)

(52) U.S. Cl. ..... 126/80; 126/77; 110/182; 454/270; 454/274; 454/275; 454/333

(58) Field of Classification Search ..... 126/77, 126/80; 110/182; 454/270, 274, 275, 333
See application file for complete search history.

(56) References Cited

U.S. PATENT DOCUMENTS

| | | | | | |
|---|---|---|---|---|---|
| 1,439,925 | A | * | 12/1922 | Street | 126/80 |
| 1,516,169 | A | * | 11/1924 | Wilkinson et al. | 126/315 |
| 2,909,983 | A | * | 10/1959 | Scheck et al. | 454/324 |
| 3,727,539 | A | * | 4/1973 | Wilmes | 454/324 |
| 4,157,704 | A | | 6/1979 | Zimmer | |
| 4,248,206 | A | * | 2/1981 | Orthey, Jr. | 126/518 |
| 4,336,443 | A | * | 6/1982 | Benedetto | 219/400 |
| 4,347,832 | A | | 9/1982 | Myers | |
| 4,369,761 | A | * | 1/1983 | Burnette | 126/521 |
| 4,387,700 | A | * | 6/1983 | Eggleston | 126/77 |
| 4,399,806 | A | * | 8/1983 | Love | 126/518 |
| 4,446,847 | A | * | 5/1984 | Martin | 126/518 |
| 4,461,275 | A | | 7/1984 | Lucas | |
| 4,466,421 | A | * | 8/1984 | Dorsch et al. | 126/285 A |
| 4,480,558 | A | | 11/1984 | Russell | |
| 4,691,686 | A | * | 9/1987 | Alvarez | 126/77 |
| 4,766,807 | A | * | 8/1988 | Davis | 454/333 |
| 4,777,871 | A | * | 10/1988 | Stowell | 454/12 |
| 4,804,391 | A | * | 2/1989 | Griffis | 96/413 |
| 4,924,850 | A | * | 5/1990 | Rieger | 126/500 |
| 4,984,560 | A | * | 1/1991 | Hazard | 126/169 |
| D318,903 | S | | 8/1991 | Lenberg | |
| 5,263,470 | A | * | 11/1993 | Whitehouse | 126/500 |
| 5,377,666 | A | * | 1/1995 | Whitehouse | 126/500 |
| D371,188 | S | | 6/1996 | Ziegenbein | |
| 5,752,935 | A | * | 5/1998 | Robinson et al. | 604/100.03 |
| 6,148,743 | A | | 11/2000 | Vatsky | |
| 6,368,206 | B1 | * | 4/2002 | Hunter et al. | 454/58 |
| 6,543,437 | B1 | * | 4/2003 | Luu et al. | 126/85 B |
| 6,758,738 | B1 | * | 7/2004 | Keller | 454/69 |
| D499,113 | S | | 11/2004 | Murayama et al. | |
| 7,036,498 | B2 | * | 5/2006 | Riepenhoff et al. | 126/110 R |
| 7,241,217 | B2 | * | 7/2007 | Demster | 454/322 |
| 7,281,972 | B2 | | 10/2007 | Tocher | |
| RE40,276 | E | * | 4/2008 | Hunter et al. | 454/58 |
| 7,497,772 | B2 | * | 3/2009 | Laib | 454/333 |
| 2008/0018103 | A1 | * | 1/2008 | Laib | 285/197 |
| 2010/0197217 | A1 | * | 8/2010 | Yoskowitz | 454/317 |

* cited by examiner

*Primary Examiner*—Kenneth B Rinehart
*Assistant Examiner*—Jorge Pereiro
(74) *Attorney, Agent, or Firm*—Crossley Patent Law; Mark A. Crossley

(57) ABSTRACT

The air intake apparatus provides for additional auxiliary air to a wood or pellet burning stove. The apparatus is provided in more than one embodiment for fit to more than one type of stove. The curved T-handle controls the damper sleeve for dampened control of the auxiliary air.

5 Claims, 5 Drawing Sheets

AIR INTAKE APPARATUS

BACKGROUND OF THE INVENTION

Many wood and pellet stoves can benefit from auxiliary air in order to enjoy more complete burn efficiency. The present apparatus provides additional air and enables a user to gain that air from the exterior of a building within which a stove is used. The apparatus also features dampened control of the auxiliary air. The apparatus is especially suited for fit to an Osburn Wood Stove.

FIELD OF THE INVENTION

The air intake apparatus relates to stoves such as wood and pellet burning stoves and more especially to a dampened auxiliary air intake for a stove.

SUMMARY OF THE INVENTION

The general purpose of the air intake apparatus, described subsequently in greater detail, is to provide a air intake apparatus which has many novel features that result in an improved air intake apparatus which is not anticipated, rendered obvious, suggested, or even implied by prior art, either alone or in combination thereof.

To attain this, the air intake apparatus provides for acquisition of auxiliary air to an existing stove, ideally outside air. The apparatus provides dampened control of the air, and therefore greater efficiency for the stove. The apparatus is provided in embodiments which allow mounting in more than one location on a stove. The damper body is sealed when closed, thereby prohibiting the influx of outside air when undesired. The inset flange provides for intake air hose hookup.

Thus has been broadly outlined the more important features of the improved air intake apparatus so that the detailed description thereof that follows may be better understood and in order that the present contribution to the art may be better appreciated.

An object of the air intake apparatus is to fit an existing stove.

Another object of the air intake apparatus is to provide auxiliary air to the stove.

A further object of the air intake apparatus is to provide dampened control of the auxiliary air.

An added object of the air intake apparatus is to fit more than one location on a stove.

And, an object of the air intake apparatus is to be easily installed and operated.

These together with additional objects, features and advantages of the improved air intake apparatus will be readily apparent to those of ordinary skill in the art upon reading the following detailed description of presently preferred, but nonetheless illustrative, embodiments of the improved air intake apparatus when taken in conjunction with the accompanying drawings.

In this respect, before explaining the current embodiments of the improved air intake apparatus in detail, it is to be understood that the air intake apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved air intake apparatus. It is therefore important that the claims be regarded as including such equivalent constructions insofar as they do not depart from the spirit and scope of the air intake apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 7 thereof, the principles and concepts of the air intake apparatus generally designated by the reference number 10 will be described.

Figure 6:
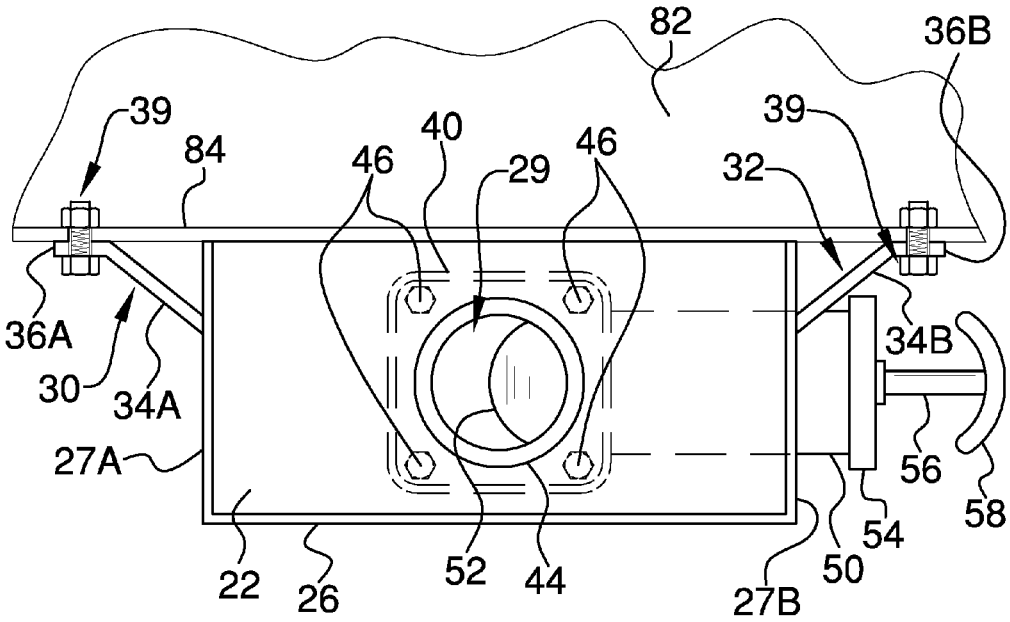
FIG. 6 is a first side elevation view of the apparatus mounted to a stove.

Referring to FIG. 6, the apparatus 10 is attached to a stove bottom 84 of an existing stove 80 via ear fasteners 39. The damper sleeve 50 is partially open, allowing auxiliary air to enter the stove bottom 84 as an aid to stove 80 combustion.

Figure 7:
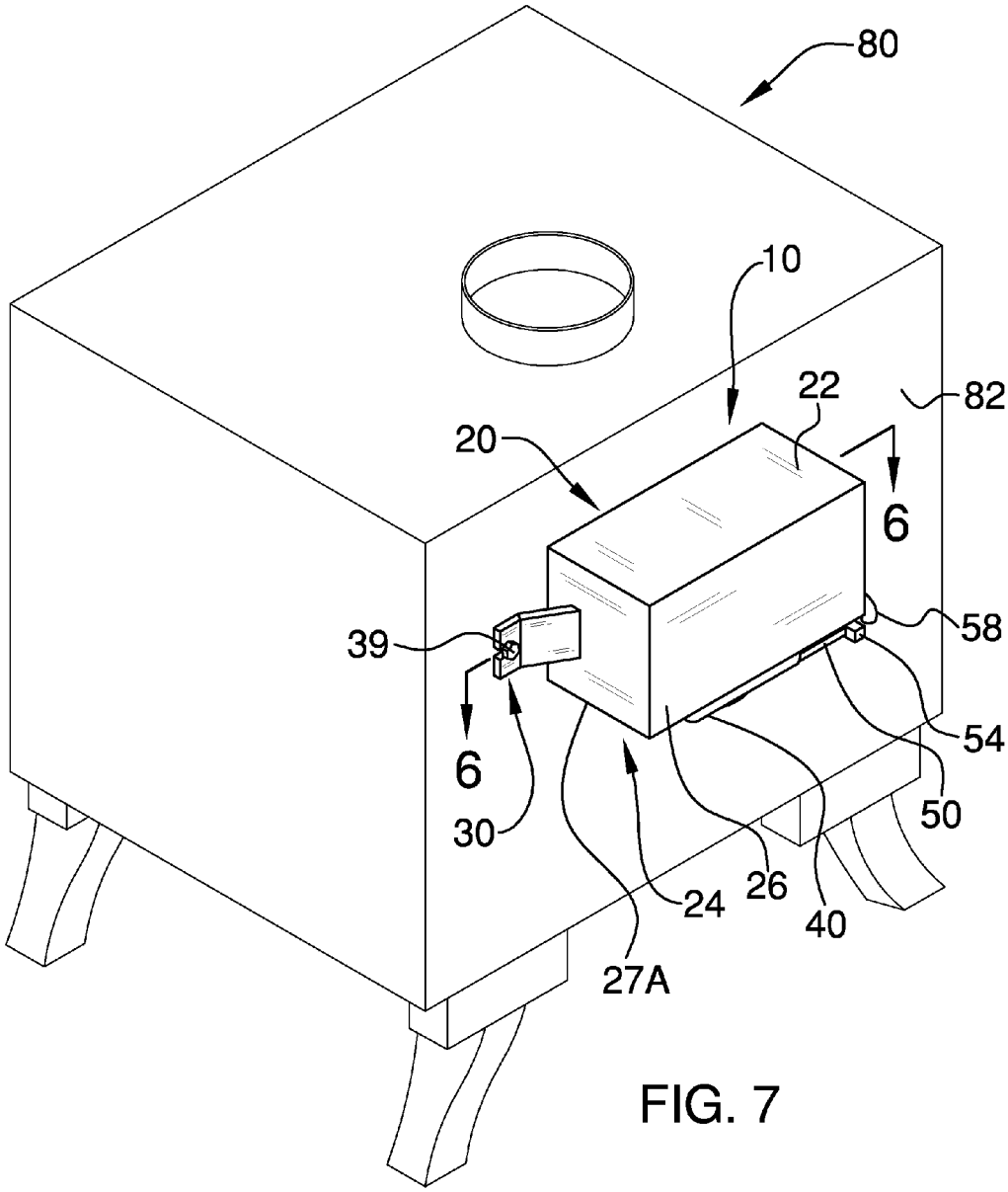
FIG. 7 is a perspective view of an alternate embodiment of the apparatus mounted to the stove back of a stove.

Referring to FIG. 7, an alternate embodiment of the apparatus 10 is affixed to the stove back 82 of the existing stove 80 via ear fasteners 39. The T-handle 58 is pulled partially outwardly such that the damper sleeve 50 allows auxiliary air intake to the stove back 82 of the stove 80. The damper body 40 is disposed on the second side 24 of the case 20.

Referring again to exemplary FIGS. 6 and 7, note that the plenum 28 and damper body 40 are optionally located on particular sides in order to accommodate various stoves 80, the choice typically determined by the availability of mounting locations, whether stove bottom 84 or stove back 82.

Figure 3:
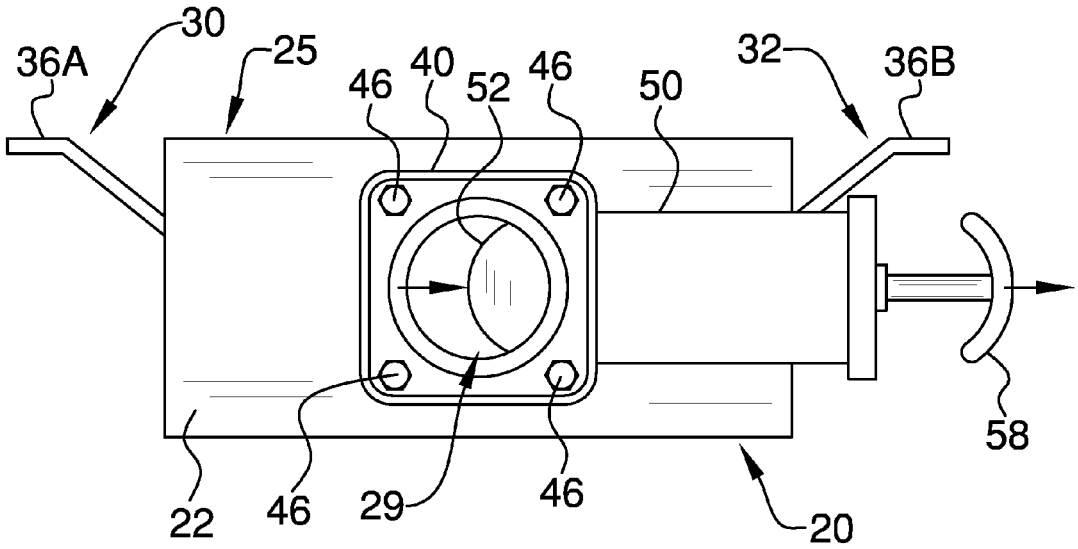
FIG. 3 is a first side elevation view of the embodiment of FIG. 1.

Referring to FIG. 3, the damper sleeve 50 is partially withdrawn to reveal the circular case opening 29 below the damper body 40. The damper sleeve 50 partially comprises the rounded end 52 for effective seal of the circular case opening 29. The curved T-handle 58 provides an enhanced grip. The curved T-handle 58 can be especially important in that high heat applications can often cause sticking of metallic components. The curved T-handle 58 enhanced grip enables a user to more effectively pull and push the damper sleeve 50 as chosen. The first ear end 36*a* and the second ear end 36*b* are coplanar with the third side 25 of the case 20, thereby providing for a flush contact of the plenum opening 28*b* of the case 20 against a stove 80. The ears relative size, angles, and strength provide for a positive sealed attachment of the apparatus 10 to a stove opening 86. A gasket (not shown) is optionally available. The gasket fits between the plenum opening 28*b* and the stove opening 86.

Figure 4:
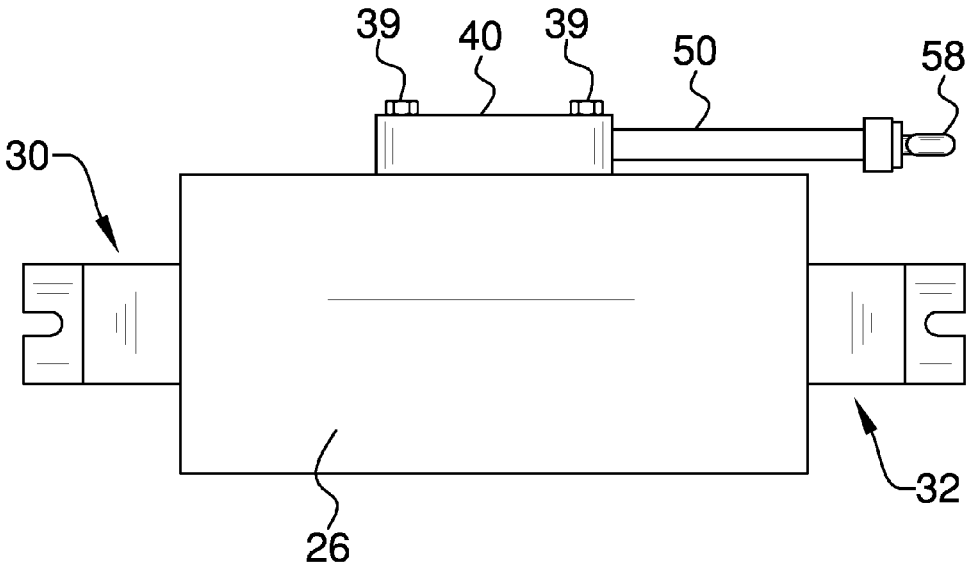
FIG. 4 is a third side elevation view of the embodiment of FIG. 1.

FIG. 4 illustrates the relatively low profile of the damper body 40, thereby ensuring adequate clearance of the apparatus 10 around extraneous objects.

Figure 1:
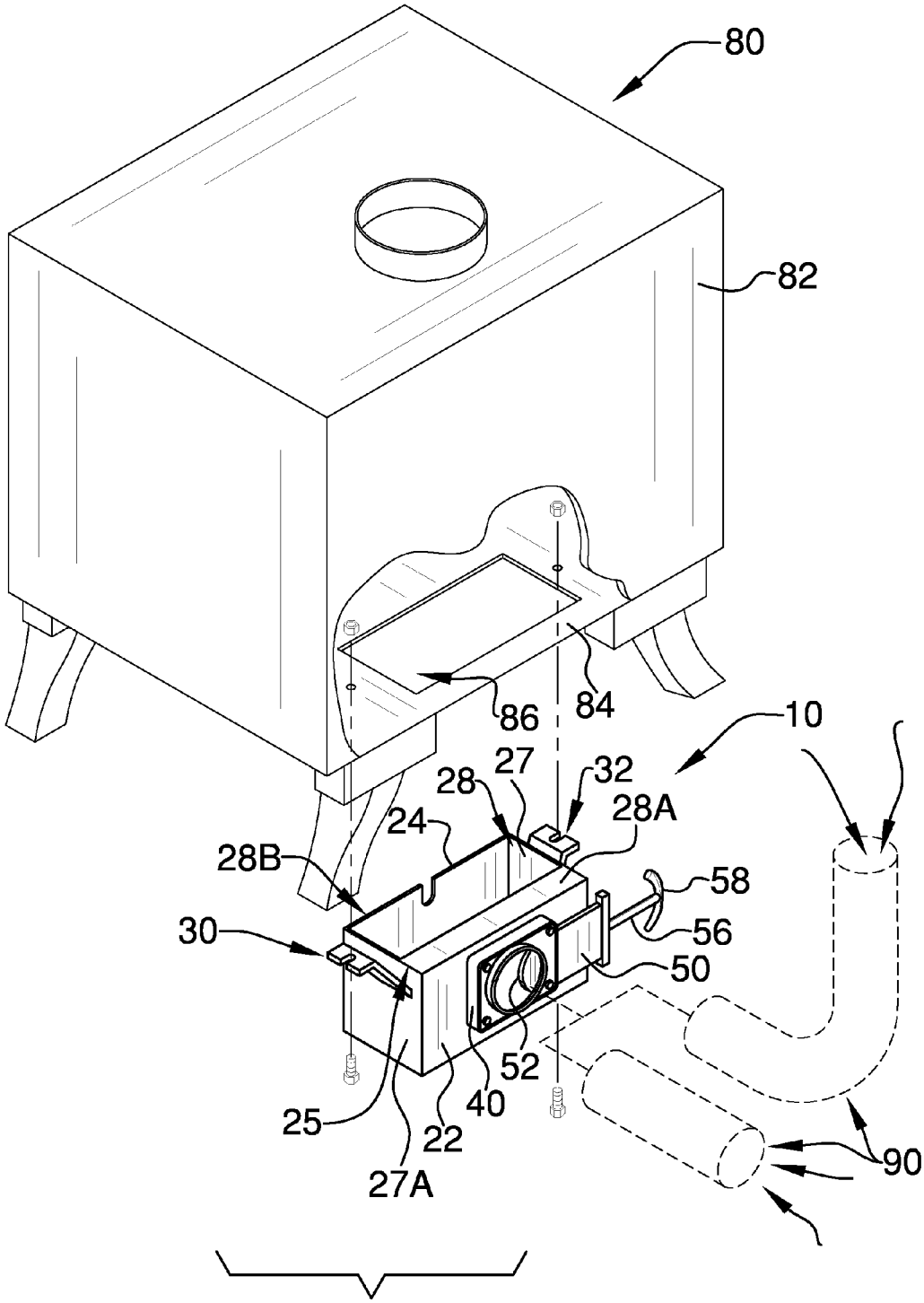
FIG. 1 is a perspective view of one embodiment in preparation of mounting to an existing stove.
Figure 2:
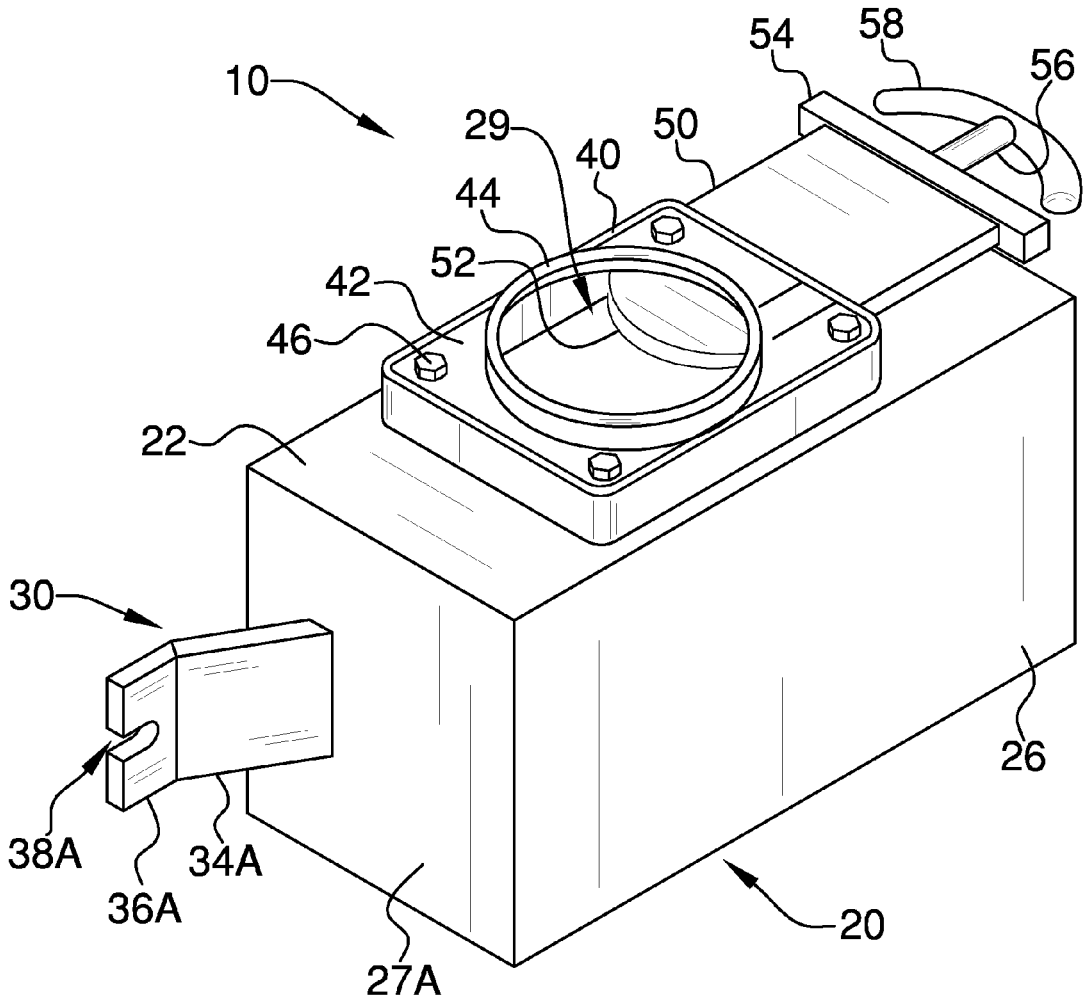
FIG. 2 is a perspective view of the embodiment of FIG. 1.

Referring to FIGS. 1 and 2, the air intake apparatus 10 further comprises the parallelepiped case 20 having a first side 22 spaced apart from a second side 24, a third side 25 spaced apart from a fourth side 26, and a first end 27*a* spaced apart from a second end 27*b*. The first mount ear 30 is disposed on the case 20 first end 27*a*. The first mount ear 30 has a first ear angle 34*a* extended into a first ear end 36*a*. The first slot 38*a* is disposed in the first ear end 36*a* of the first mount ear 30 and provides for a measure of forgiveness in location of the ear fastener 39 in fastening the apparatus 10 to a stove 80. The second mount ear 32 is disposed on the case 20 second end 27*b*. The second mount ear 32 has a second ear angle 34*b* extended into the second ear end 36*b*. The second slot 38*b* in the second ear end 36*b* provides for a measure of forgiveness in location of the ear fastener 39. An ear fastener 39 selectively fastens each ear end slot to an existing stove 80. The plenum opening 28*b* is disposed in the first side 22 of the case 20. The plenum opening 28*b* is fitted to an existing stove opening 86 in the stove 80. The partial panel 28*a* is disposed adjacent to the plenum opening 28*b* of the plenum 28. The case 20 is much larger than the circular case opening 29, thereby providing that the plenum 28 hold sufficient air to not hinder draft from the stove 80. The circular case opening 29 is, in any embodiment, disposed in a side of the case 20 not shared with the plenum 28. The substantially square damper body 40 is attached over the circular case opening 29. The inset flange 44 is fitted within the damper inset 42. The damper body 40 and damper inset 42 are secured to the case via the damper fasteners 46. The round inset flange 44 is selectively affixed to an existing air intake hose 90 thereby allowing the apparatus 10 to acquire air from outside of a building. The round inset flange 44 accommodates an existing hose 90. Inset flanges 44 are available in varied diameters. The advantages of outside air are multiple. Two important advantages are that the stove 80 does not deplete interior oxygen. Further, the stove 80 burns more efficiently with fresh air source. Further, the apparatus 10 damper components provide for adjusting the flow of outside air, further regulating burn within the stove 80. The damper sleeve 50 is slideably fitted within the damper body 40. The sleeve seal 54 disposed on the sleeve 50 opposite the rounded end 52. The shaft 56 is extended from the sleeve seal 54. The curved T-handle 58 is affixed to the shaft 56. The relative sizes of the inset flange 44 and circular case opening 29, along with the plenum 28 size, plenum opening 28*b* and adjacent partial panel 28*a* are a result of research of air flow through the apparatus 10 and the size of the needed stove opening 86 in the stove 80.

Referring to FIG. 3, the first ear end 36*a* of the first mount ear 30 and the second ear end 36*b* of the second mount ear 32 are coplanar with the fourth side 26 of the embodiment of the apparatus 10.

Figure 5:
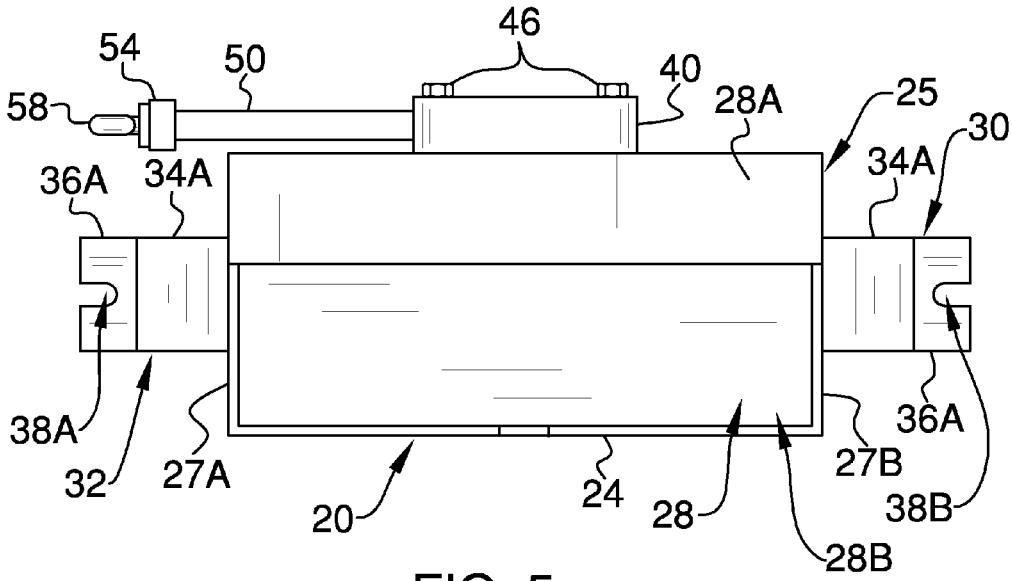
FIG. 5 is a fourth side elevation view of an alternate embodiment.

Referring to FIG. 5, the plenum opening 28*b* with adjacent partial panel 28*a* is disposed on the fourth side 26 of the case 20. The damper sleeve 50 is positioned within the damper body 40 in the fully open position. When the damper sleeve 50 is slid inwardly, the sleeve seal 54 seals against the damper body 40.

With respect to the above description then, it is to be realized that the optimum dimensional relationships for the parts of the air intake apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the air intake apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the air intake apparatus may be used.

Therefore, the foregoing is considered as illustrative only of the principles of the air intake apparatus. Further, since numerous modifications and changes will readily occur to those skilled in the art, it is not desired to limit the air intake apparatus to the exact construction and operation shown and described, and accordingly, all suitable modifications and equivalents may be resorted to, falling within the scope of the air intake apparatus.

What is claimed is:

1. An air intake apparatus comprising:

a parallelepiped case having a first side spaced apart from a second side, a third side spaced apart from a fourth side, a first end spaced apart from a second end;

means for mounting the case on an existing stove;

a plenum disposed within the case;

a plenum opening disposed in one side of the case, the plenum opening in communication with the plenum, the plenum opening fitted to an existing stove opening in the stove;

a case opening disposed in one side of the case not shared with the plenum opening;

a damper body attached over the case opening;

a damper inset disposed within the damper body;

an inset flange fitted within the damper inset, the inset flange selectively affixed to an existing air intake hose;

a plurality of damper fasteners affixing the damper inset and damper body to the case;

a damper sleeve slideably fitted within the damper body;

a sleeve seal disposed on the sleeve, the seal exterior to the damper body;

a shaft extended from the sleeve seal;

a handle affixed to the shaft;

wherein a partial panel is further disposed adjacent to the plenum opening.

2. The apparatus according to claim 1 wherein the case opening further comprises a circular case opening; and further comprising a rounded end on the damper sleeve.

3. The apparatus according to claim 2 wherein the handle affixed to the shaft further comprises a curved T-handle.

4. The apparatus according to claim 1 wherein the handle affixed to the shaft further comprises a curved T-handle.

5. An air intake apparatus, comprising:

a parallelepiped case having a first side spaced apart from a second side, a third side spaced apart from a fourth side, a first end spaced apart from a second end;

a first mount ear disposed on the case first end, the first mount ear having a first ear angle extended into a first ear end;

a first slot in the first ear end of the first mount ear;

a second mount ear disposed on the case second end, the second mount ear having a second ear angle extended into a second ear end;

an ear fastener selectively fastening each ear end slot to an existing stove;

a second slot in the second ear end of the second mount ear;

a plenum disposed within the case;

a plenum opening disposed in one side of the case, the plenum opening in communication with the plenum, the plenum opening fitted to an existing stove opening in the stove;

a partial panel disposed adjacent to the plenum opening;

a circular case opening disposed in one side of the case not shared with the plenum opening;

a substantially square damper body attached over the circular case opening;

a substantially square damper inset disposed within the damper body;

a round inset flange fitted within the damper inset, the inset flange selectively affixed to an existing air intake hose;

a plurality of damper fasteners affixing the damper inset and damper body to the case;

a damper sleeve slideably fitted within the damper body;

a rounded end on the damper sleeve;

a sleeve seal disposed on the sleeve opposite the rounded end;

a shaft extended from the sleeve seal;

a curved T-handle affixed to the shaft.

* * * * *